US012473926B1

(12) United States Patent
Carroll et al.

(10) Patent No.: US 12,473,926 B1
(45) Date of Patent: Nov. 18, 2025

(54) IMPELLERS AND MANUFACTURING METHODS THEREOF

(71) Applicant: Morrison Products, Inc., Cleveland, OH (US)

(72) Inventors: David M. Carroll, Mentor on the Lake, OH (US); Jeffrey S. Nagal, Mayfield Heights, OH (US)

(73) Assignee: MORRISON PRODUCTS, INC., Cleveland, OH (US)

( * ) Notice: Subject to any disclaimer, the term of this patent is extended or adjusted under 35 U.S.C. 154(b) by 0 days.

(21) Appl. No.: 18/804,981

(22) Filed: Aug. 14, 2024

(51) Int. Cl.
*F04D 29/28* (2006.01)
*F04D 29/62* (2006.01)

(52) U.S. Cl.
CPC ..... *F04D 29/282* (2013.01); *F04D 29/626* (2013.01)

(58) Field of Classification Search
CPC ..... Y10T 29/49321; Y10T 29/49936; Y10T 403/7033; Y10T 403/7035; F04D 29/626
See application file for complete search history.

(56) References Cited

U.S. PATENT DOCUMENTS

| | | | |
|---|---|---|---|
| 7,438,522 | B2 | 10/2008 | Eimer |
| 7,794,206 | B2 | 9/2010 | Keber |
| 8,109,731 | B2 | 2/2012 | Keber |
| 8,167,564 | B2 | 5/2012 | Streng |
| 8,257,043 | B2 * | 9/2012 | Kuroki ..... F04D 29/282 416/236 R |
| 9,004,868 | B2 | 4/2015 | Rhodes |
| 9,157,452 | B2 | 10/2015 | Sadi |
| 9,505,092 | B2 | 11/2016 | Brownell |
| 9,810,234 | B2 | 11/2017 | Bähren |
| 9,976,560 | B2 | 5/2018 | Brownell |
| 9,982,674 | B2 | 5/2018 | Kreidler |
| 9,985,494 | B2 | 5/2018 | Kreidler |
| D821,564 | S | 6/2018 | Conrad |
| 10,001,020 | B2 | 6/2018 | Barry |
| 10,012,236 | B2 | 7/2018 | Cocks |
| 10,030,667 | B2 | 7/2018 | Pirouzpanah |
| 10,036,400 | B2 | 7/2018 | Cocks |
| 10,124,783 | B2 | 11/2018 | Spieker |
| 10,230,290 | B2 | 3/2019 | Kreidler |
| 10,393,138 | B2 | 8/2019 | Gebert |
| 10,519,978 | B2 | 12/2019 | Gebert |

(Continued)

FOREIGN PATENT DOCUMENTS

| | | |
|---|---|---|
| WO | 2004079201 | 9/2004 |
| WO | 2008015233 | 2/2008 |

(Continued)

*Primary Examiner* — Brian O Peters
(74) *Attorney, Agent, or Firm* — Calfee, Halter & Griswold LLP

(57) ABSTRACT

An impeller includes a front plate, a back plate, and a plurality of blades. The front plate has one or more first openings and one or more first locking projections, and the back plate has one or more second openings and one or more second locking projections. Each blade has one or more first and second tabs. The first tabs extend through the first openings of the front plate, and the first locking projections exert a force on the first tabs to secure the blades to the front plate. The second tabs extend through the second openings of the back plate, and the second locking projections exert a force on the second tabs to secure the blades to the back plate.

20 Claims, 14 Drawing Sheets

(56) References Cited

U.S. PATENT DOCUMENTS

| | | | |
|---|---|---|---|
| 10,550,854 | B2 | 2/2020 | Lörcher |
| 10,619,641 | B2 | 4/2020 | Roessler |
| 10,816,009 | B2 | 10/2020 | Lörcher |
| 10,920,786 | B2 | 2/2021 | Konzal |
| 10,995,767 | B2 | 5/2021 | Pirouzpanah |
| 11,255,348 | B2 | 2/2022 | Maiorano |
| 11,371,529 | B2 | 6/2022 | Loercher |
| 11,391,282 | B2 | 7/2022 | Keber |
| 11,421,704 | B2 | 8/2022 | Gruber |
| 11,428,238 | B2 | 8/2022 | Haaf |
| 11,480,186 | B2 | 10/2022 | Johnson |
| 11,506,220 | B2 | 11/2022 | Gebert |
| 11,649,829 | B2 | 5/2023 | Gebert |
| 11,668,314 | B2 | 6/2023 | Frank |
| 11,768,090 | B2 | 9/2023 | Loercher |
| 2007/0201982 | A1 | 8/2007 | Neumeier |
| 2017/0241431 | A1 | 8/2017 | Wolf |
| 2017/0306974 | A1 | 10/2017 | Wolf |
| 2023/0124865 | A1 | 4/2023 | Heigold |

FOREIGN PATENT DOCUMENTS

| | | |
|---|---|---|
| WO | 2012123080 | 9/2012 |
| WO | 2017036470 | 3/2017 |
| WO | 2018065283 | 4/2018 |
| WO | 2018184946 | 10/2018 |
| WO | 2019115703 | 6/2019 |
| WO | 2020124024 | 6/2020 |
| WO | 2020207542 | 10/2020 |
| WO | 2021259429 | 12/2021 |
| WO | 2022103868 | 5/2022 |

* cited by examiner

IMPELLERS AND MANUFACTURING METHODS THEREOF

TECHNICAL FIELD

The present invention relates generally to an impeller and, more particularly, an impeller for heating, ventilation, or air conditioning (HVAC) systems, as well as impeller manufacturing methods.

BACKGROUND

Impellers for HVAC systems typically include connecting multiple components (e.g., blades, a front plate, a back plate, a hub or other means of shaft attachment, etc.). The connection between the various components often consists of welding, staking, or spinning. The impeller can connect to a drive member (e.g., a motor shaft) such that the drive member can rotate the impeller. The impeller may be disposed within a housing or compartment (e.g., plenum) and positioned such that rotation of the impeller causes air or other gases to move in a desired direction and through an outlet of the housing or compartment.

SUMMARY

An exemplary embodiment of an impeller includes a front plate, a back plate, and a plurality of blades. The front plate has a plurality of first openings and a plurality of first locking projections, and the back plate has a plurality of second openings and a plurality of second locking projections. Each blade has one or more first and second tabs. The first tabs extend through the first openings of the front plate, and the first locking projections exert a force on the first tabs to secure the blades to the front plate. The second tabs extend through the second openings of the back plate, and the second locking projections exert a force on the second tabs to secure the blades to the back plate.

Another exemplary embodiment of an impeller includes a front plate, a back plate, and a plurality of blades. The front plate has a plurality of first openings and a plurality of first locking projections, and the back plate has a plurality of second openings and a plurality of second locking projections. Each blade has one or more first and second tabs. The first tabs are configured to be inserted into the first openings of the front plate, and the second tabs are configured to be inserted into the second openings of the back plate. The first locking projections are configured to be moved to a closed position relative to the first openings such that the first locking projections engage the first tabs and cause the first tabs to be secured to the front plate. The second locking projections are configured to be moved to a closed position relative to the second openings such that the second locking projections engage the second tabs and cause the second tabs to be secured to the back plate.

An exemplary method of assembling an impeller includes inserting one or more first tabs of a blade into one or more first openings of a front plate, and moving one or more first locking projections of the front plate to a closed position relative to the one or more first openings to secure the blade to the front plate. The method also includes inserting one or more second tabs of the blade into one or more second openings of a back plate, and moving one or more second locking projections of the back plate to a closed position relative to the one or more second openings to secure the blade to the back plate.

DETAILED DESCRIPTION

The Detailed Description describes exemplary embodiments of the invention and is not intended to limit the scope of the claims in any way. Indeed, the invention is broader than and unlimited by the exemplary embodiments, and the terms used in the claims have their full ordinary meaning. Features and components of one exemplary embodiment may be incorporated into the other exemplary embodiments. Inventions within the scope of this application may include additional features, or may have less features, than those shown in the exemplary embodiments.

The exemplary impellers described herein are configured for simple assembly while maintaining an increased strength of a joint connection between the blades and the front and back plates. The impellers described herein may include a self-fixturing feature that maintains the blades in a desired position relative to the front and back plates prior to final assembly. The impellers also may have a locking feature that secures the blades to the front and back plates prior to final assembly. Moreover, the blades can be finally assembled with a simple axial staking method that secures the blades to the front and back plates. The impellers described herein refer to single-inlet impellers. However, it should be understood that the features described herein can be used with double-inlet impellers.

Figure 1:
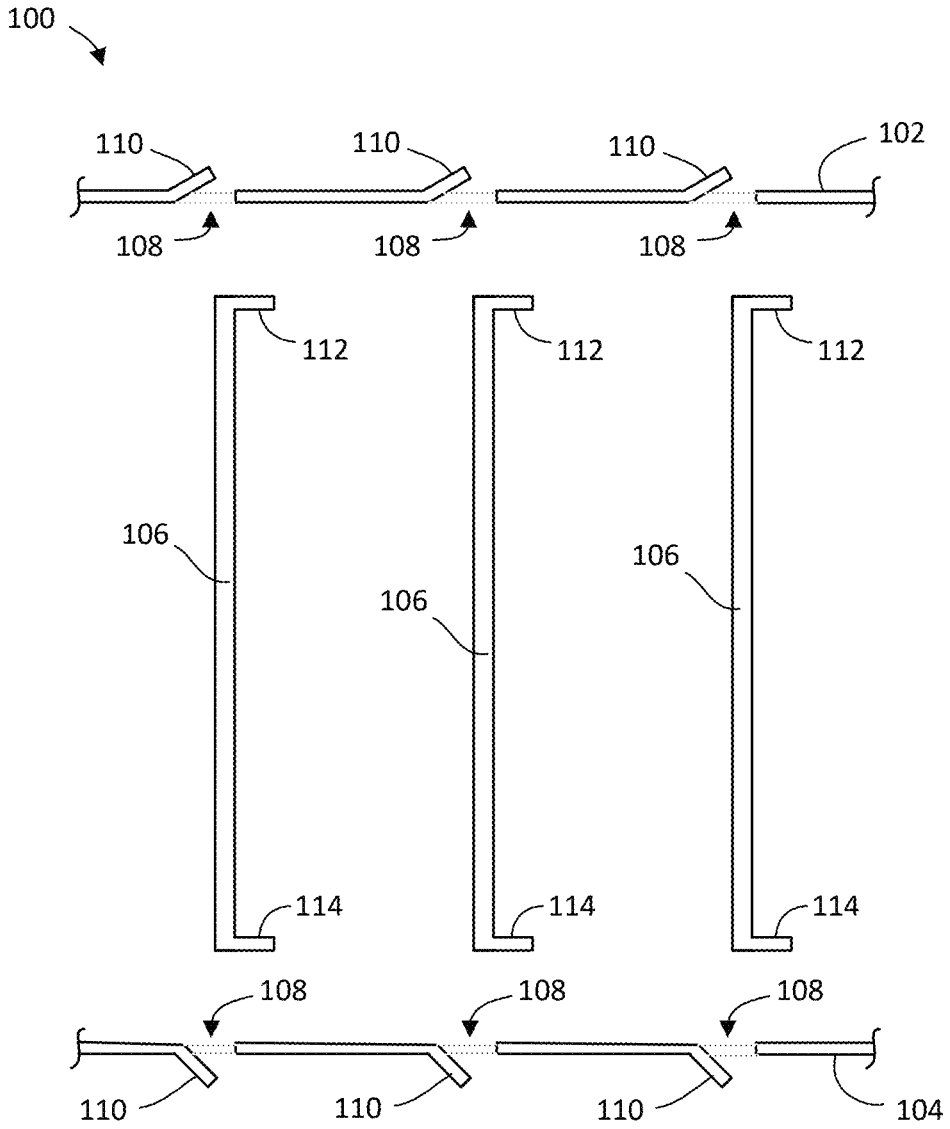
FIG. 1 is a plan view an exemplary embodiment of an impeller assembly, where a blade and plates of the impeller are in a disassembled state.
Figure 2:
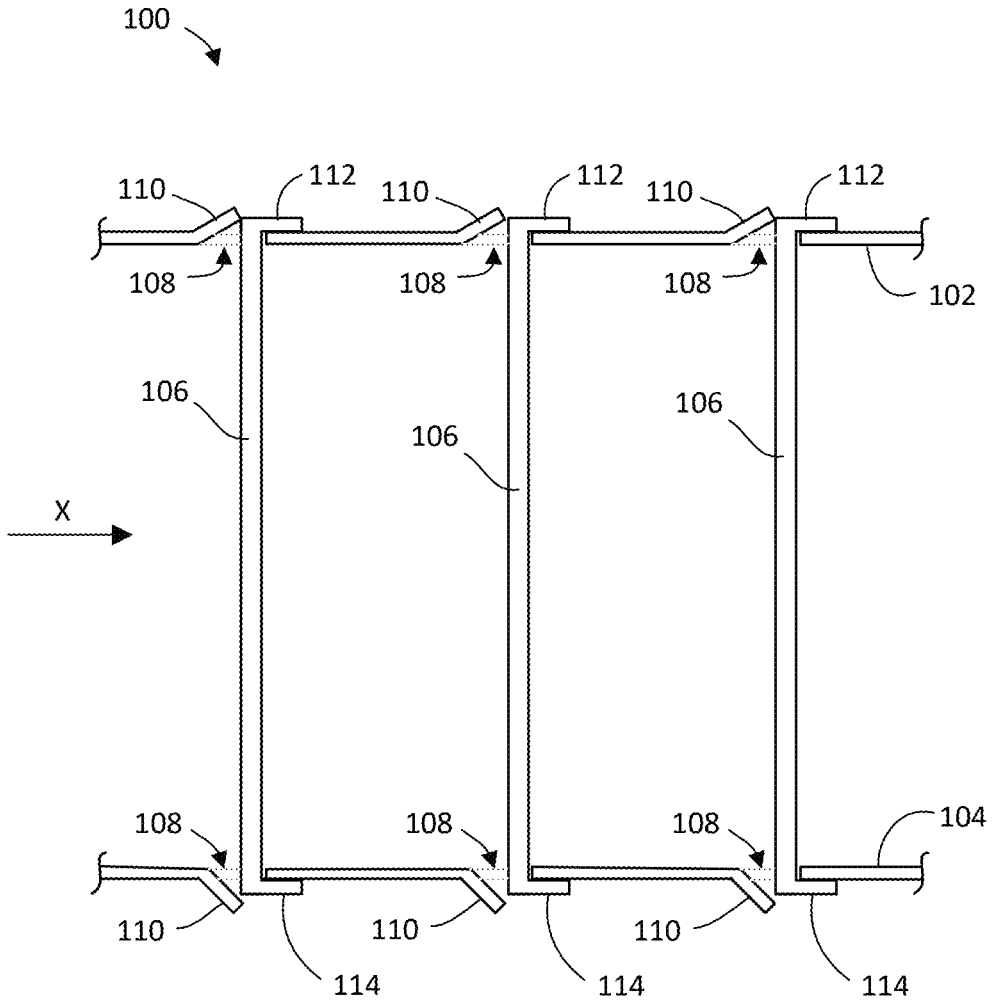
FIG. 2 is a plan view of the impeller of FIG. 1, where the blade and plates of the impeller are in an initial connecting position.
Figure 3:
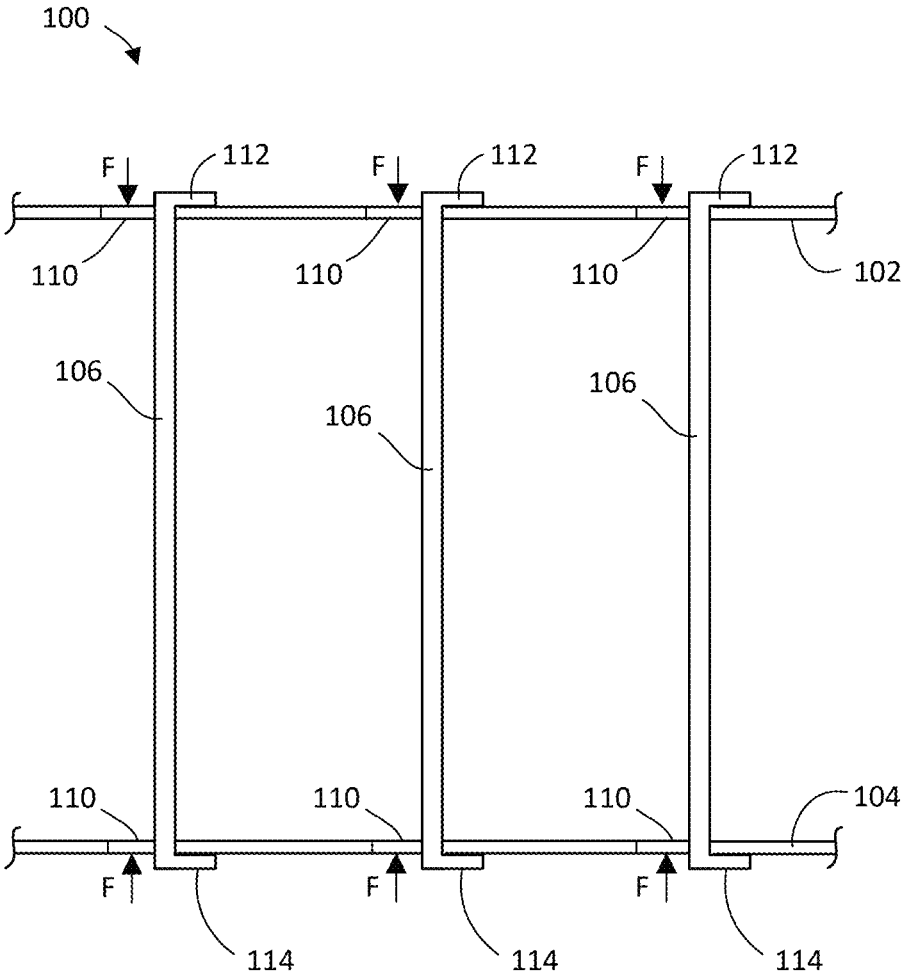
FIG. 3 is a plan view of the impeller of FIG. 1, where the blade and plates of the impeller are in a connected position.

FIGS. 1 through 3 illustrate an exemplary embodiment of an impeller 100 includes a front plate 102, a back plate 104, and a plurality of blades 106. The front and back plates 102, 104 can be made of a metal material, such as, for example, steel, aluminum, or any other suitable material. The blades 106 can be made of a metal or composite material, such as, for example, steel, aluminum, plastic, filled polymer, or any other suitable material. The blades 106 can be straight blades, forward-curved blades, backward-curved blades, airfoil blades, or any other suitable shape blades. The impeller 100 can be used in a fan for an HVAC system (e.g., the fan 2200 shown in FIG. 22).

The plates 102, 104 have one or more openings 108 and one or more locking projections 110 that extend above the openings 108. The locking projections 110 are configured to be moved between a normal position (as shown in FIG. 1) to a closed position (as shown in FIG. 3) relative to the openings 108. In certain embodiments, the locking projections 110 are substantially aligned with a main body of the corresponding plates 102, 104 when in the closed position. That is, an axis extending through the each locking projection 110 is substantially aligned with an axis of the corresponding plate 102, 104. The locking projections 110 may be moved between the normal and closed positions by a pressing machine (e.g., pressing machine 1201 described in the present application) or one or more assembly persons using a pressing tool. The locking projections 110 can include features that facilitate movement of the locking projections between the normal and closed positions when engaged by the pressing tool. For example, the locking projections 110 can include curved portions, weakened portions, holes, slots, chamfers, bevels, tapers, expansions, compressions, etc. One of the plates 102, 104 may have a connection feature (not shown) for connecting to a drive shaft, such that a drive mechanism of a fan can be used to rotate the drive shaft and, consequently, the impeller 100. The drive shaft can connect to the corresponding plate 102, 104 by any suitable means.

The blades 106 have first tabs 112 that are configured to extend through the openings 108 of the front plates 102 and second tabs 114 that are configured to extend through the openings 108 of the back plate 104. The first and second tabs 112, 114 engage the locking projections 110 once inserted into the openings 108, which positions the blades 106 in a desired position for connection to the plates 102, 104. This engagement between the tabs 112, 114, the openings 108, and the locking projections 110 acts as a self-fixturing feature that maintains the blades 106 in a desired position for connection with the plates 102, 104.

In certain embodiments, the first and second tabs 112, 114 can then be moved into engagement with plates 102, 104 such that the blades are secured to the plates 102, 104 prior to the locking projection 110 being moved to the closed position. For example, the first and second tabs 112, 114 of the blades 106 can include a locking feature that secures the blades 106 to the plates 102, 104. The locking feature can be a slot (e.g., slot 230 described in the present application) that is configured to receive the corresponding plate 102, 104 and maintain a mechanical connection with the plate 102, 104. The locking feature can include, for example, a friction-fit connection, a snap fit connection, a tab and hook connection, an undercut tab in the slot, or any other suitable type of mechanical connection. The locking feature allows the non-assembled impeller 100 to be moved to a pressing machine or other type of machine such that the locking projections can be moved to the closed position.

The corresponding locking projections 110 of the plates 102, 104 can be moved to a closed position to engage the corresponding tab 112, 114 to finally assemble the impeller 100 by securing the blades 106 to the plates 102, 104. While the illustrated embodiment shows the blades 106 having a single first tab 112 for connecting to front plate 102 and a single second tab 114 for connecting to the back plate 104, it should understood that that blades 106 can have any suitable number of first and/or second tabs, such as, for example, one or more tabs, two or more tabs, three or more tabs, four or more tabs, five or more tabs, etc. The blades 106 can include more first tabs 112 than second tabs 114, more second tabs 114 than first tabs 112, or the same amount of first and second tabs.

FIG. 1 shows the impeller 100 in a disassembled state. The impeller 100 can be sent to a worksite in the disassembled state and then assembled on-site, or the impeller 100 can be preassembled prior to sending to the worksite. Referring to FIG. 2, the first tabs 112 of the blades 106 are inserted into the openings 108 of the front plate 102, and the second tabs 114 of the blades 106 are inserted into the openings 108 of the back plate 104. In certain embodiments, the blades 106 are moved in a direction X such that the first tabs 112 move over and engage an outer surface of the front plate 102 and the second tabs 114 move over and engage an outer surface of the back plate 104. The blades 106 can be moved, for example, by a component of an assembly machine. A locking feature of the blades 106 can be used to secure the blades 106 to the plates 102, 104 while the locking projections 110 are maintained in the open position.

Referring to FIG. 3, a force F is applied to the locking projections 110 to cause the locking projections 110 to move to the closed position such that the locking projections 110 engage the corresponding tabs 112, 114 and secure the blades 106 to the front and back plates 102, 104. In certain embodiments, the force F can be provided to the locking projections by a pressing machine.

Figure 4:
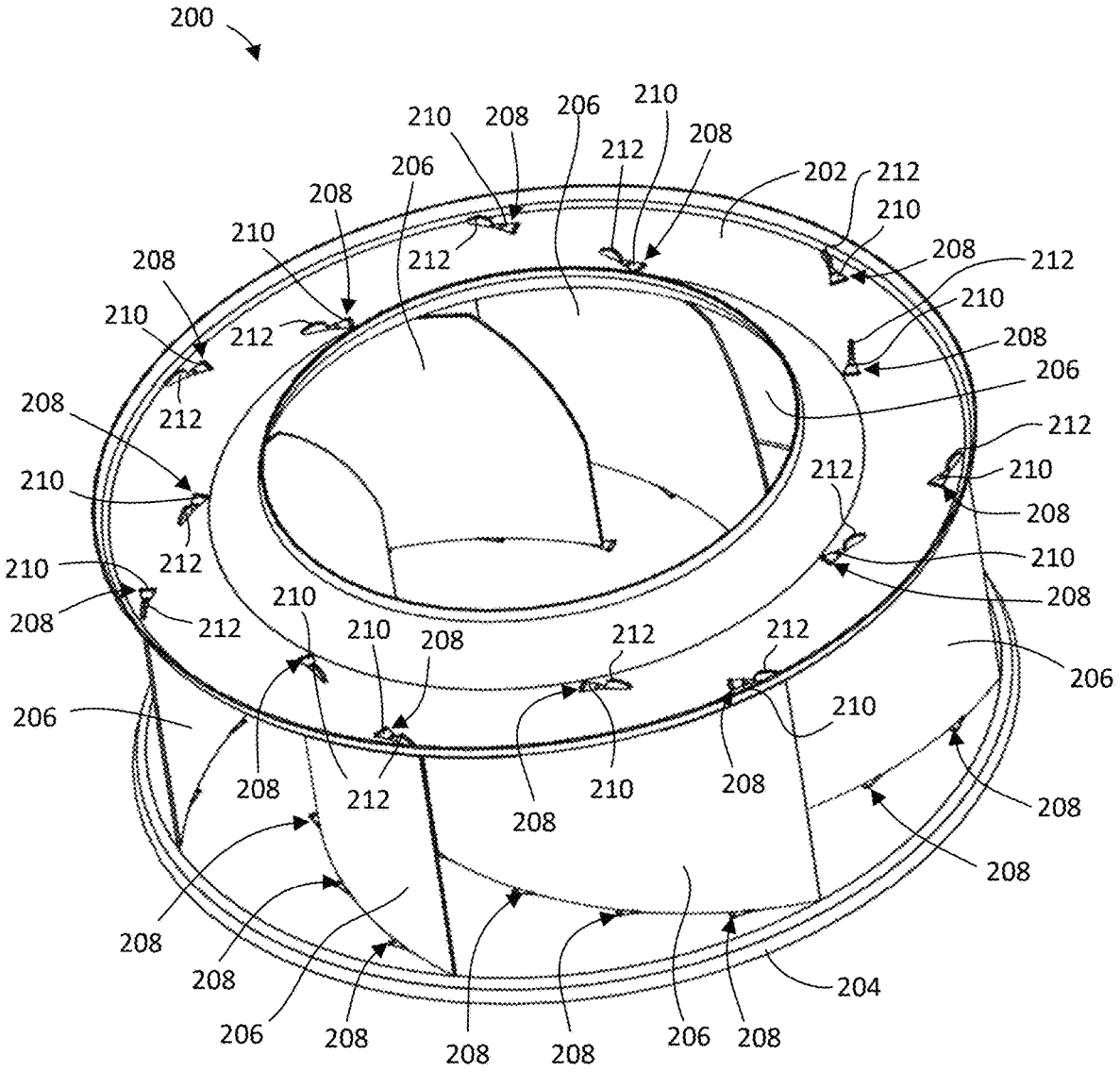
FIG. 4 is a top isometric perspective view of another exemplary embodiment of an impeller.
Figure 5:
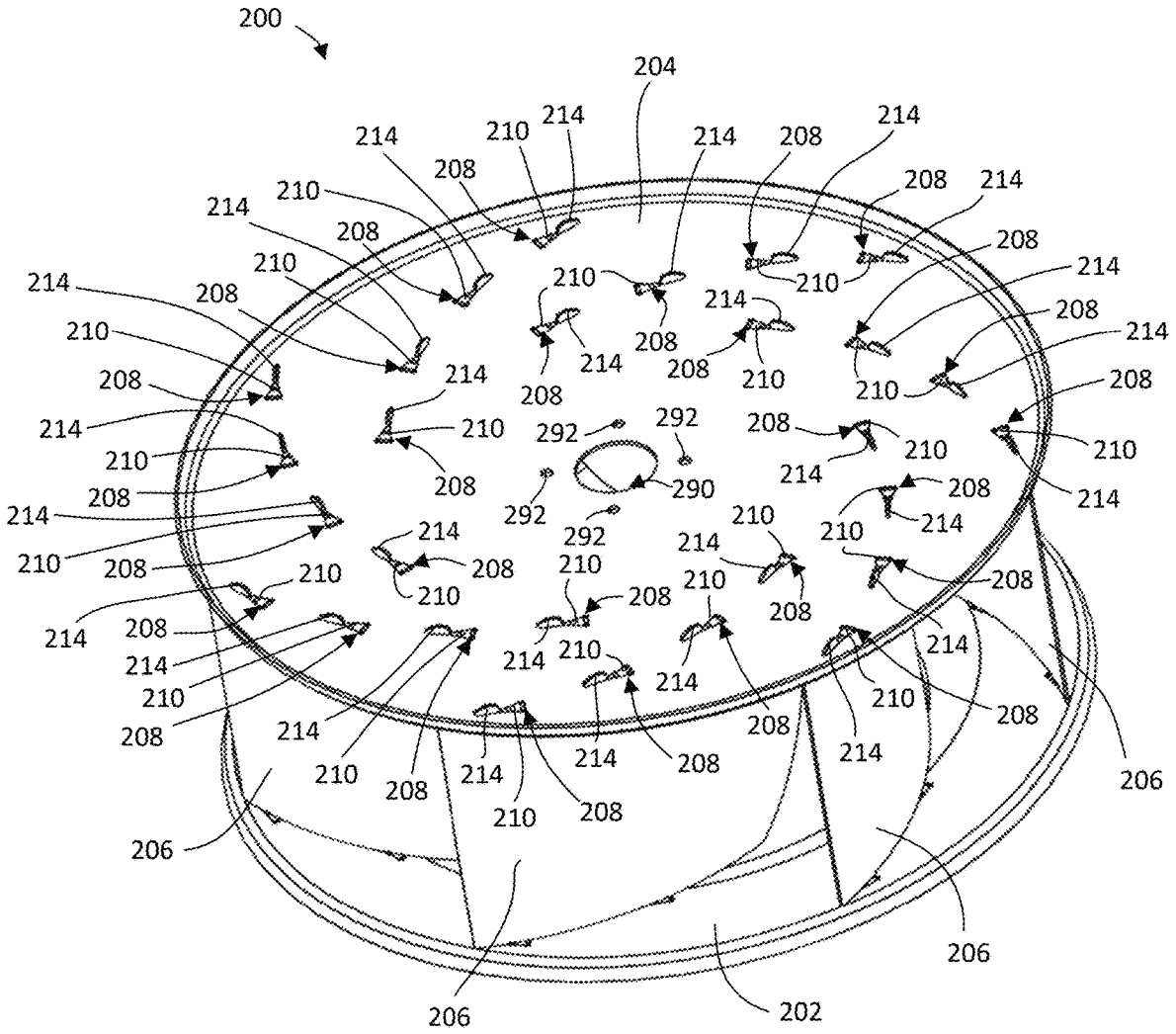
FIG. 5 is a bottom isometric perspective view of the impeller of FIG. 4.

FIGS. 4 through 17 illustrate another embodiment of an impeller 200. Referring to FIGS. 4 and 5, the impeller 200 includes a front plate 202, a back plate 204, and a plurality of blades 206. The front and back plates 202, 204 can be made of a metal material, such as, for example, steel, aluminum, or any other suitable material. The blades 206 can be made of a metal material, such as, for example, Steel, aluminum, plastic, filled polymer, or any other suitable material. In the illustrated embodiment, the blades 206 are backward-curved blades. In other embodiments, the blades 206 can be straight blades or forward-curved blades, airfoil blades, or any other suitable shape blades. The blades 206 can take any suitable form, such as, for example, any form described in the present application. The impeller 200 can be used in a fan for a heating, ventilation, or air conditioning system (e.g., the fan 2200 shown in FIG. 22).

The plates 202, 204 can have openings 208 and locking projections 210 that extend above the openings 208. The locking projections 210 are configured to be moved from a normal position (as shown in FIGS. 6-13) to a closed position (as shown in FIGS. 4-5 and 16-17) relative to the openings 208. As shown in the illustrated embodiment, the locking projections 210 can be substantially aligned with a remainder of the corresponding plates 202, 204 when in the closed position. That is, an axis extending through the each locking projection 210 is substantially aligned with an axis of the corresponding plate 202, 204. The locking projections 210 may be moved between the normal and closed positions by a pressing tool 1201 (FIGS. 12, 14, and 16), such as, for example, a pressing tool of an assembly machine. Referring to FIG. 5, the back plate 204 can have an opening 290 for receiving a drive shaft (not shown), and the drive shaft can be secured to the back plate 204 by fasteners (e.g., bolts). In the illustrated embodiment, the back plate 204 include four holes 292 for receiving fasteners to connect the drive shaft to the back plate. The back plate 204 can, however, any suitable number of holes 292 for receiving fasteners. The impeller 200 can include a hub (not shown) that is fastened to the back plate 204 (e.g., via threaded fasteners, rivets, a crimp connection, a welded connection, or any other suitable connection means). In other examples, the back plate 204 can be directly connected to a rotor of the motor.

The blades 206 have first tabs 212 that are configured to extend through the openings 208 of the front plates 202 and second tabs 214 that are configured to extend through the openings 208 of the back plate 204. The first and second tabs 212, 214 engage the corresponding locking projections 210 of the plates 202, 204 when in the closed position (as shown in FIGS. 4-5 and 16-17), which secures the blades 206 to the plates 202, 204. Referring to FIG. 4, in the illustrated example, each of the blades 206 has two first tabs 212 for connecting to the front plate 202. The blades 206 can, however, have any suitable number of tabs for connecting to the front plate 202, such as, for example, one or more tabs, two or more tabs, three or more tabs, four or more tabs, five or more tabs, etc. Referring to FIG. 5, in the illustrated example, each of the blades 206 has four second tabs 214 for connecting to the back plate 204. The blades 206 can, however, have any suitable number of tabs for connecting to the back plate 204, such as, for example, one or more tabs, two or more tabs, three or more tabs, four or more tabs, five or more tabs, etc. While the blades 206 are shown as having less first tabs 212 for connecting to the front plate 202 than second tabs 214 for connecting to the back plate 204, it should be understood that the blades 206 can have the same amount of first tabs 212 and second tabs 214, or the blades 206 can have more first tabs 212 than second tabs 214.

FIGS. 6 through 17 illustrate an exemplary method for connecting a first tab 212 of the blades 206 to the front plate 202. However, it should be understood that the structure of the second tabs 214 can be identical to the first tab 212, and the method for connecting the second tabs 214 to the back plate 204 can be identical to the connection between the first tab 212 and the front plate 202. The first tab 212 has a base 217, a first elongated portion 218, and a second elongated portion 220. The base 217 extends from the main body 216 of the blade 206. The second elongated portion 220 is configured to engage with the locking projection 210, and the first elongated portion 218 is configured to engage with the plate 202. In the illustrated embodiment, the tab 212 has an appearance similar to a duck head. However, the tab 212 may have any other suitable configuration.

Figure 6:
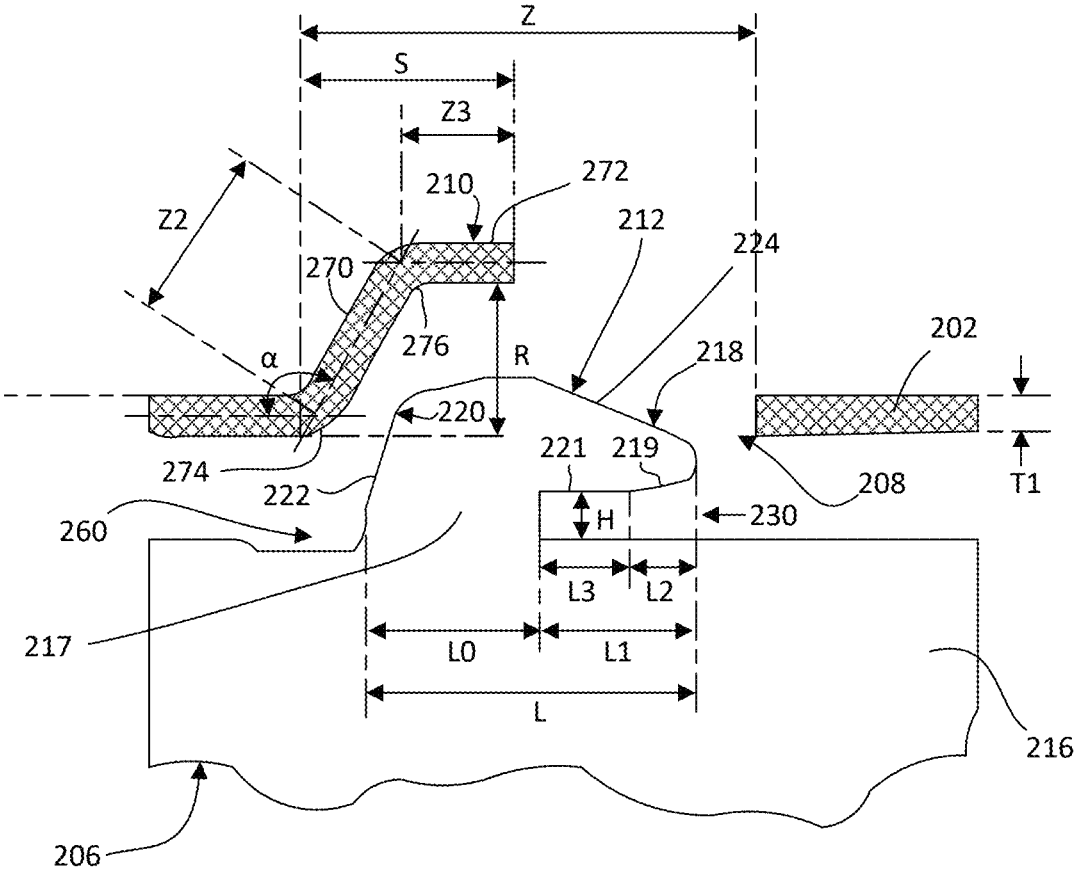
FIG. 6 is a cross-sectional side view of exemplary embodiments of a blade and plate for the impeller of FIG. 4, where the blade and plate are in a disassembled state.

Referring to FIG. 6, the second elongated portion 220 of the tab 212 can have a rear tapered wall 222. The shape of the second elongated portion 220 is advantageous because allows for easy assembly and positioning of the tab 212 throughout the assembly process. For example, the second elongated portion allows for an easy insertion of the blade into the opening 208. That is, engagement between the tapered wall 222 and the plate 202 as the tab 212 is being inserted into the opening 208 will cause the tab 212 to move toward the opening 208. The junction between the main body 216 of the blade 206 and the base 217 and second elongated portion 220 of the tab 212 can include a receiving channel 260 for receiving the locking projection 210 of the plate 202, which aids in securing the blade 206 to the plate 202. While the illustrated embodiment shows the junction between the body 216 and tab 212 having the receiving channel, it should be understood that the receiving channel can be disposed entirely on the tab 212 or entirely on the body 216 of the blade 206.

The first elongated portion 218 of the tab 212 can have a front tapered wall 224 that allows for an easy insertion of the blade 206 into the opening 208. That is, engagement between the tapered wall 224 and the plate 202 as the tab 212 is being inserted into the opening 208 will cause the tab 212 to move toward the opening 208. In the illustrated example, the first elongated portion 218 has a slot 230 for receiving the plate 202. In certain embodiments, the slot 230 has a height H that is greater than or equal to a thickness T1 of the plate 202 such that the plate 202 can be inserted into the slot 230. In various instances, a ratio of the height H of the slot 230 to the thickness T1 can be between about 1 to 1 and about 1.3 to 1. The portion 219 of the front elongated portion 218 of the tab 212 can take any form that helps facilitate insertion of the plate 202 into the slot 230. For example, the portion 219 can have one or more tapered edges, curved edges, or other shapes that help facilitate insertion of the plate 202 into the slot 230. The tab 212 can have a thickness T2. In some instances, the thickness T1 of the plate 202 and the thickness T2 of the tab 212 are substantially the same. In other instances, the thickness T1 of the plate is different than the thickness T2 of the tab 212.

The tab 212 can have an overall length L with a base 217 having a length L0 and an elongated portion 218 having a length L1, where length L can be substantially equal to the sum of the lengths L0, L1. In some instances, a ratio of the length L0 of the base 217 to the overall length L of the tab 212 can be between about 0.4 to 1 and about 0.7 to 1. In some instances, a ratio of the length L1 of the elongated portion 218 to the overall length L of the tab 212 can be between about 0.3 to 1 and about 0.6 to 1. The elongated portion 218 of the tab 212 can have a first portion 219 having a length L2 and a second portion 221 having a length L3, where the first portion 219 can have a coarse taper (relative to the second portion 221) that allows for initial movement of the tab 212 to the position shown in FIGS. 10 and 11, and where the second portion 221 can a fine taper (relative to the first portion 219) that allows for movement of the tab 212 to the position shown in FIGS. 12 and 13.

Figure 7:
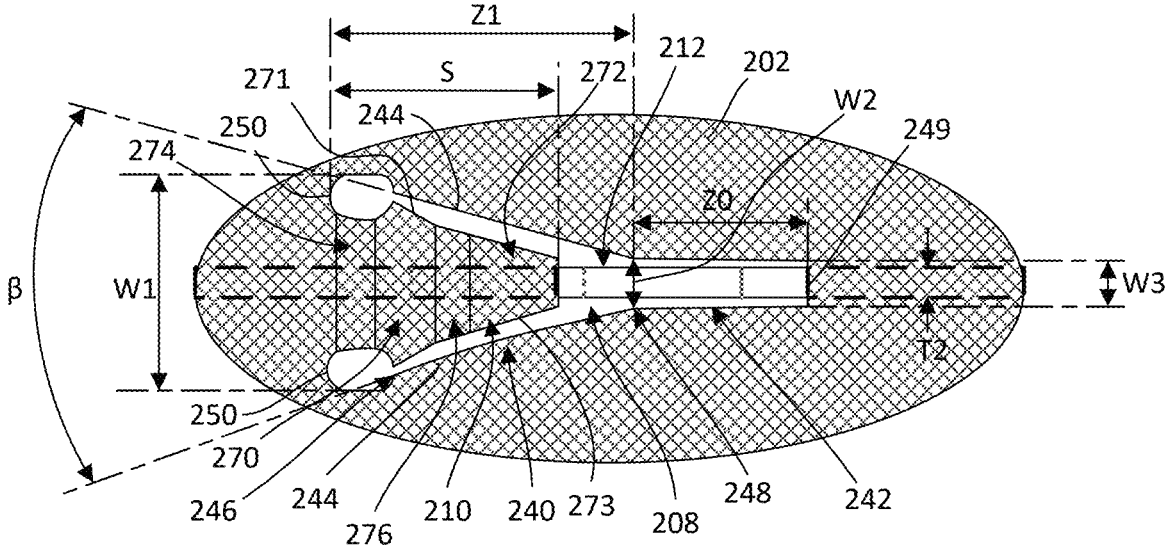
FIG. 7 is top view of the blade and plate of FIG. 6, shown in the disassembled state illustrated in FIG. 6.
Figure 8:
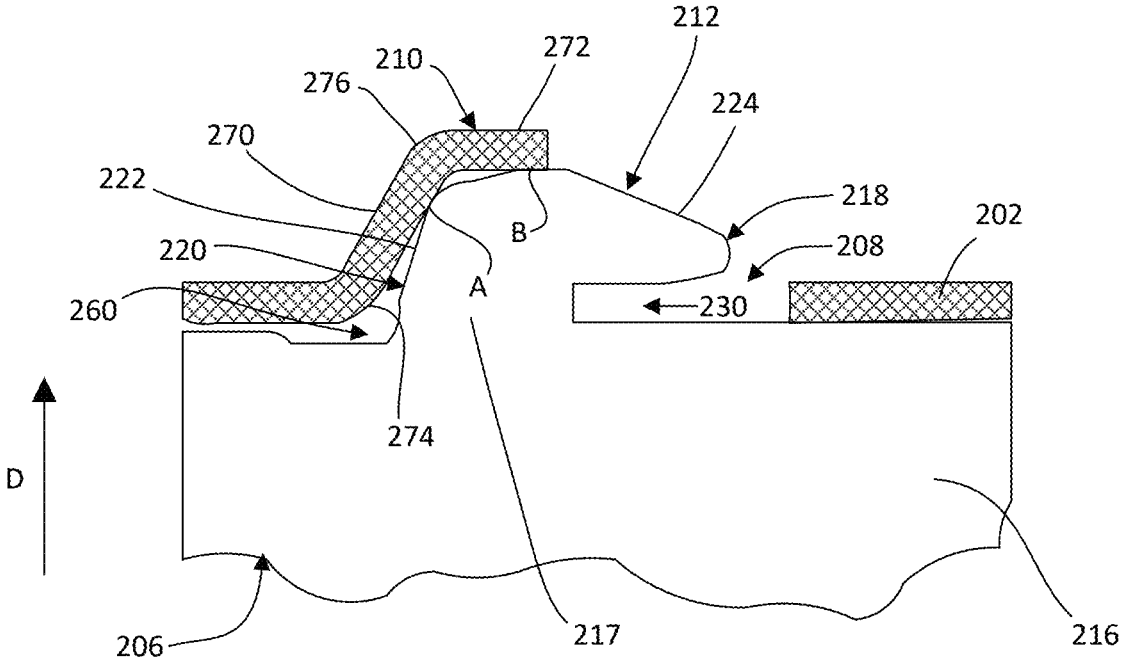
FIG. 8 is a front view of the blade and plate of FIG. 6, where blade and plate are in an initial connecting position.
Figure 9:
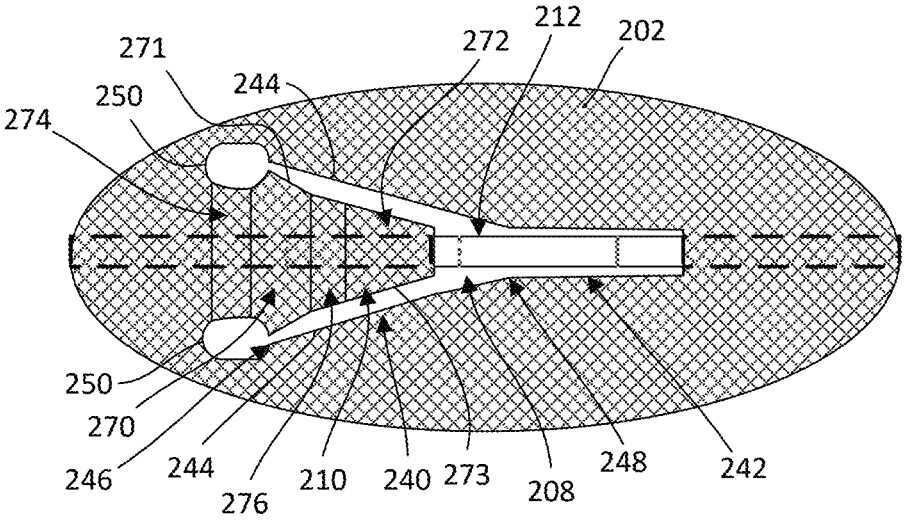
FIG. 9 is a top view of the blade and plate of FIG. 6, shown in the initial connecting position illustrated in FIG. 8.

Referring to FIGS. 6 and 7, the opening 208 of the plate 202 includes a first portion 240 that aligns with and corresponds to a shape of the locking projection 210 when the locking projection 210 is in the closed position, and the opening 208 includes a second portion 242 that aligns with and corresponds to a shape of the tab 212 of the blade 206. In the illustrated example, the first portion 240 is shown as having a trapezoidal shape, and the second portion 242 is shown as having a rectangular shape. In some instances, the second portion 242 has a trapezoidal shape. It should be understood that the first and second portions 240, 242 can have any suitable shape, such as, for example, trapezoidal, rectangular, triangular, circular, any other suitable shape, and any combinations thereof. It should also be understood that the first and second portions 240, 242 can have side edges that have any suitable shape, such as, for example, straight edges, curved edges, or any edges taking any other suitable form. The opening 208 can have a total length Z with the first portion 240 having a length Z1 and the second portion 242 having a length Z0.

In various implementations, the overall length L of the tab 212 is less than or equal to the overall length Z of the opening 208, which allows for the tab 212 to be inserted into the opening 208 during assembly of the impeller 200. For example, a ratio of the length L of the tab 212 to the length Z of the opening 208 can be between about 0.5 to 1 and about 1 to 1. The length Z0 of the second portion 242 of the opening 208 can be sized to be less than or equal to the length L0 of the base 217 of the tab 212. For example, a ratio of the length Z0 to the length L0 can be between about 0.9 to 1 and about 1 to 1. This ratio allows for a secure connection of the blade 206 to the plate 202 when the locking projection 210 is moved to the closed position to connect the blade 206 to the plate. The length Z1 of the first portion 240 of the opening 208 is substantially equal to a sum of the lengths Z2, Z3 of the first and second elongated portions 270, 272 of the locking projection 210, which allows the locking projection 210 to substantially fill the first portion 240 of the opening 208 when the locking projection 210 is moved to the closed position.

A front side 249 of the second portion 242 of the opening 208 can have a width W3. In some examples, a ratio of the width W3 to the thickness T2 of the tab 212 can be between about 1 to 1 and about 1.35 to 1. In some instances, the second portion 242 of the opening 208 has a uniform width. In other instances, the second portion 242 has a width that varies from a rear side (e.g., the front side 248 of the first portion 240 of the opening 208) to the front side 249. The width W3 and length Z0 of the second portion 242 can correspond to the length and/or width of the base 217 of the tab 212. The first portion 240 of the opening 208 can include tapered side walls 244 that extend from a rear side 246 to a front side 248 of the first portion 240. In certain embodiments, the front side 248 of the first portion 240 can have a width W2. A ratio of the width W2 to the width W3 can be between about 1 to 1 and about 1.8 to 1. The rear side 246 of the first portion 240 of the opening 208 can a width W1, where the width W1 is a function of the width W2, an angle β between the tapered side walls 244, and the length Z1 of the first portion 240 of the opening 208. The angle β can be between about 15 degrees and about 45 degrees.

Referring to FIGS. 6 and 7, the locking projections 210 can include a first elongated portion 270, a second elongated portion 272, a first curved portion 274, and a second curved portion 276. The locking projections can be moved from the normal position to the closed position when engaged by the pressing tool 1201 (FIG. 12) or any other machine capable of moving the locking projections 210 from the normal position to the closed position. The first curved portion 274 extends from the main body of the plate 202, and the first elongated portion 270 extends from the first curved portion 274 such that the first elongated portion 270 extends at an angle α relative to the main body of the plate 202. When in the locking projection 210 is in the normal position, the angle α can be between about 105 degrees and about 140 degrees. The second curved portion 276 extends from the first elongated portion 270, and the second elongated portion 272 extends from the second curved portion 276 such that the second elongated portion 272 is substantially parallel with the main body of the plate 202. In other embodiments, the second elongated portion 272 may not be parallel with the main body of the plate 202 when the locking projection 210 is in the normal position.

Referring to FIG. 6, in some embodiments, the locking projection 210 may extend a height R above the main body of the plate 202. A ratio of the height R to the thickness T1 of the locking projection 210 can be, for example, between about 2.5 to 1 and about 6.5 to 1. Referring to FIG. 6, the first and second elongated portions 270, 272 of the locking projections 210 can have a length S when the locking projection 210 is in the normal (pre-closed) position. The first elongated portion 270 can extend at the angle α and have a length Z2, and the second elongated portion 272 can extend from the first elongated portion 270 by a length Z3. A ratio of the length Z2 of the first elongated portion 270 to the length Z3 of the second elongated portion 272 can be between about 1 to 1 and about 3 to 1. Referring to FIGS. 6 and 7, the first and second elongated portions 270, 272 of the locking projection 210 may have tapered side walls 271, 273, where the tapered side walls 271, 273 correspond to the shape of the first portion 240 of the opening 208.

The opening 208 can include strain relief portions 250 that are adjacent to the rear side 246 of the first portion 240. The strain relief portions 250 provide a defined bend line and reduces stress concentrations during the making of the locking projections 210. The strain relief portions 250 can have a circular shape, an oval shape, a curved shape, or any other suitable shape. In various examples, the strain relief portions 250 have a shape that is configured to avoid sharp corners during the making of the locking projections 210. In various implementations, the locking projection 210 can be formed by creating openings that become the strain relief portions 250 in the plate 202, and creating an opening that becomes the second portion 242 of the opening 208. These openings can be created by cutting through the plate 202. Once these openings are created, the plates are cut between the strain relief portions 250 and the first portion 240 to form the edges 244 of the first portion 240 of the opening 208, and the material of the plate 202 within the opening and between the edges 244 is pushed outward to create the locking projections 210.

Referring to FIGS. 6 and 7, the exemplary method of connecting the blade 206 to the front plate 202 includes positioning the tab 212 in alignment with the opening 208. After the tab 212 is aligned with the opening 208, referring to FIGS. 8 and 9, the blade 206 is moved in the direction D such that the tab 212 is inserted into the opening 208. In certain implementations, the tab 212 can be inserted into the opening 208 such that it engages the locking projection 210. While the blade 206 is shown being moved in the direction D to insert the tab 212 into the opening 208, it should be understood that, alternatively, the plate 202 can be moved toward the blade 206 to insert the tab 212 into the opening 208. The engagement between tab 212 and the locking projection 210 positions the tab 212 such that the slot 230 (FIG. 6) for receiving the plate 202 is aligned with the plate 202. In the illustrate embodiment, the tab 212 has a first contact point A and a second contact point B with the locking projection 210. These contact points A, B facilitate a desired alignment between the tab 212 and the opening 208 and allow for an ease of assembly between the blade 206 and the plate 202. In other embodiments, the tab 212 can have more or less than two contact points with the locking projection.

Figure 10:
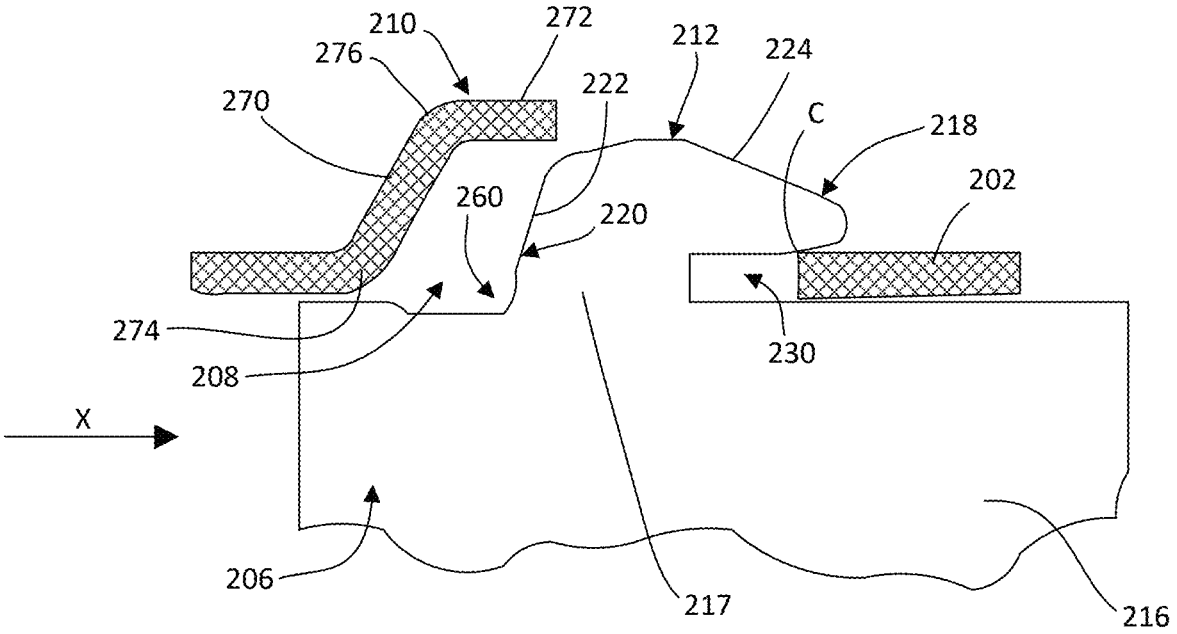
FIG. 10 is a front view of the blade and plate of FIG. 6, where blade and plate are in a second connecting position.
Figure 11:
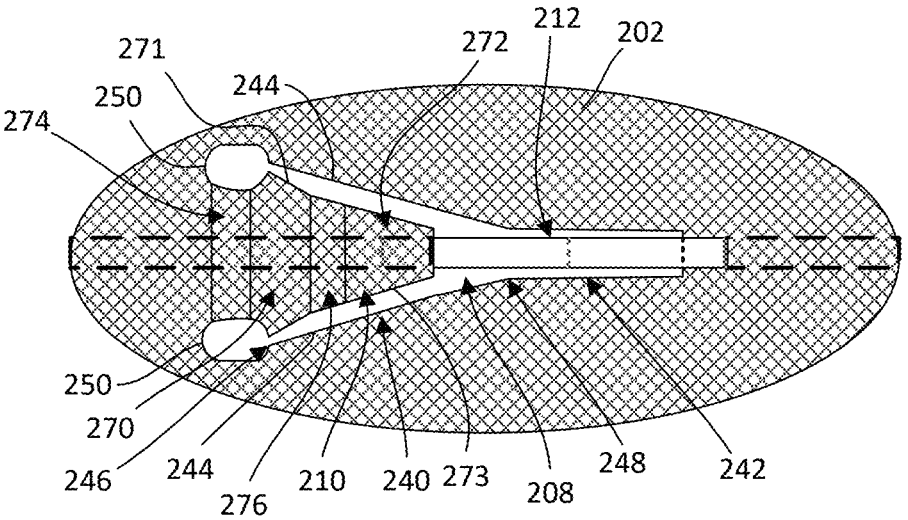
FIG. 11 is a top view of the blade and plate of FIG. 6, shown in the second connecting position illustrated in FIG. 10.

Referring to FIGS. 10 and 11, once the slot 230 (FIG. 6) of the blade 206 is aligned with the plate 202, the blade 206 is moved in the direction X until the tab 212 engages the plate 202. In the illustrate embodiment, the tab 212 has a contact point C with the plate 202. In other embodiments, the tab 212 can have more than one contact points with the plate 202. The thickness T1 (FIG. 6) of the plate 202 and the height H (FIG. 6) of the slot 230 of the tab 212 causes the plate 202 to engage the tab 212 at the contact point C. The movement of the blade in the direction X can be done by one or more assembly persons or by an assembly machine (not shown).

Figure 12:
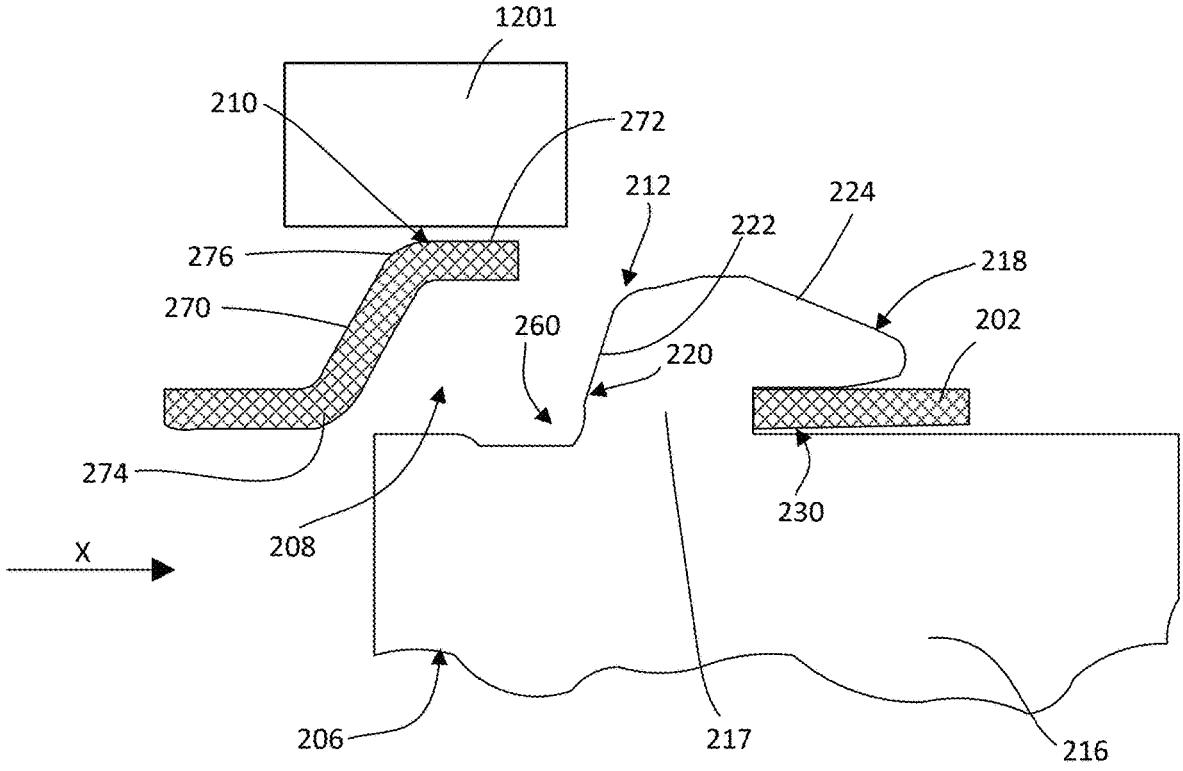
FIG. 12 is a front view of the blade and plate of FIG. 6, where blade and plate are in a third connecting position.
Figure 13:
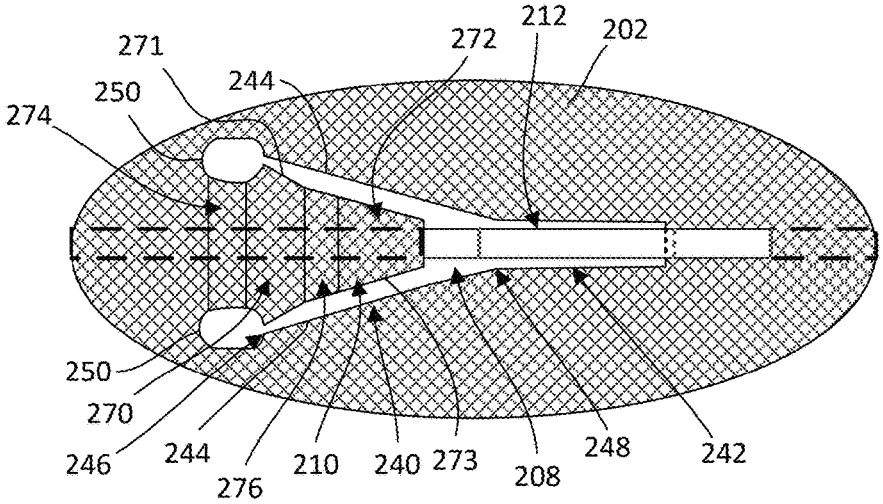
FIG. 13 is a top view of the blade and plate of FIG. 6, shown in the third connecting position illustrated in FIG. 12.

Referring to FIGS. 12 and 13, further movement of the blade 206 in the direction X causes the plate 202 to be inserted into the slot 230. In certain embodiments, this movement of the blade 206 that causes the plate 202 to be inserted into the slot 230 can be completed by an assembly machine (not shown). For example, the thickness T1 (FIG. 6) of the plate 202 and the height H (FIG. 6) of the slot 230 establishes a magnitude of force that is required to cause the plate 202 to be inserted into the slot 230, and an assembly machine can be used to provide the required force to cause the plate 202 to be inserted into the slot 230. The thickness T1 of the plate 202 and the height H of the slot 230 also provides for a secure connection between the blade 206 and the plate 202 when the plate 202 is disposed within the slot 230. To finish assembly of the impeller 200, after the tab 212 of the blade 206 is disposed within the slot 230, a pressing machine 1201 (e.g., a manually, mechanically, hydraulically, or otherwise operated machine that includes a pressing tool that extends or otherwise moves to engage a desired component) of an assembly machine can be used to move the locking projection 210 to the closed position. Alternatively, one or more assembly persons can use a pressing tool (not shown) to move the locking projection 210 to the closed position.

Figure 14:
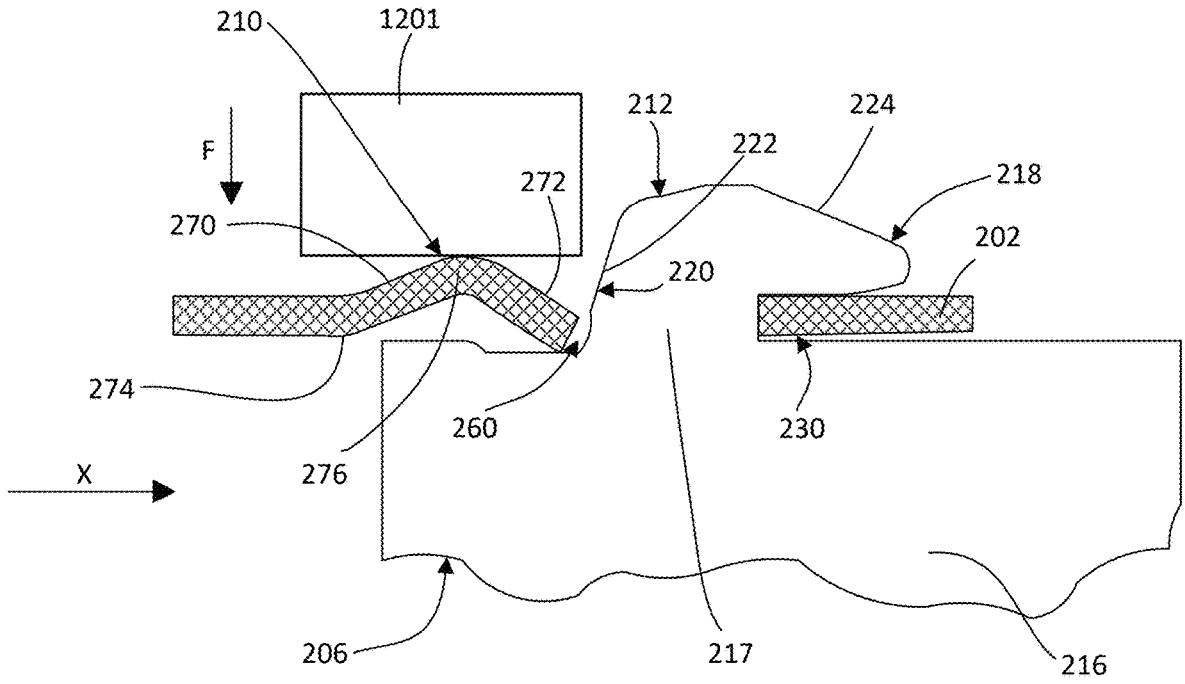
FIG. 14 is a front view of the blade and plate of FIG. 6, where a pressing tool of an assembly machine engages an exemplary locking projection of the plate to move the locking projection into engagement with the blade.
Figure 15:
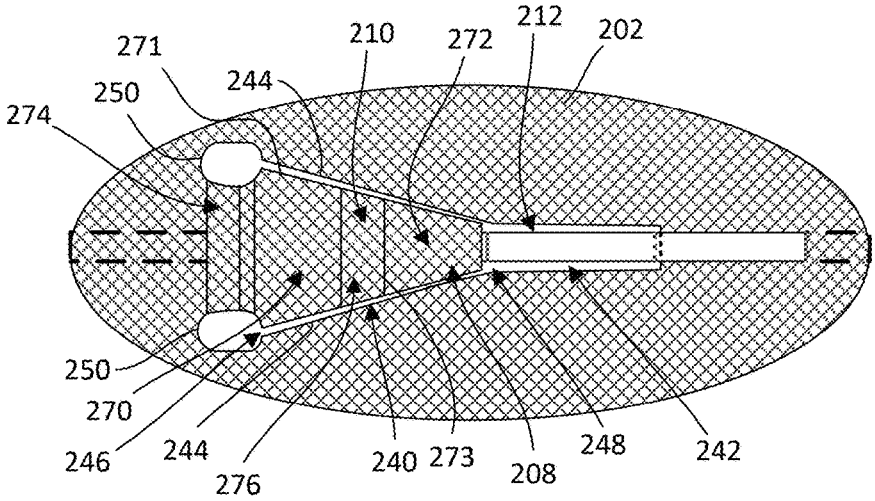
FIG. 15 is a top view of the blade and plate of FIG. 6, showing the locking projection of the plate engaging the blade as illustrated in FIG. 14.
Figure 16:
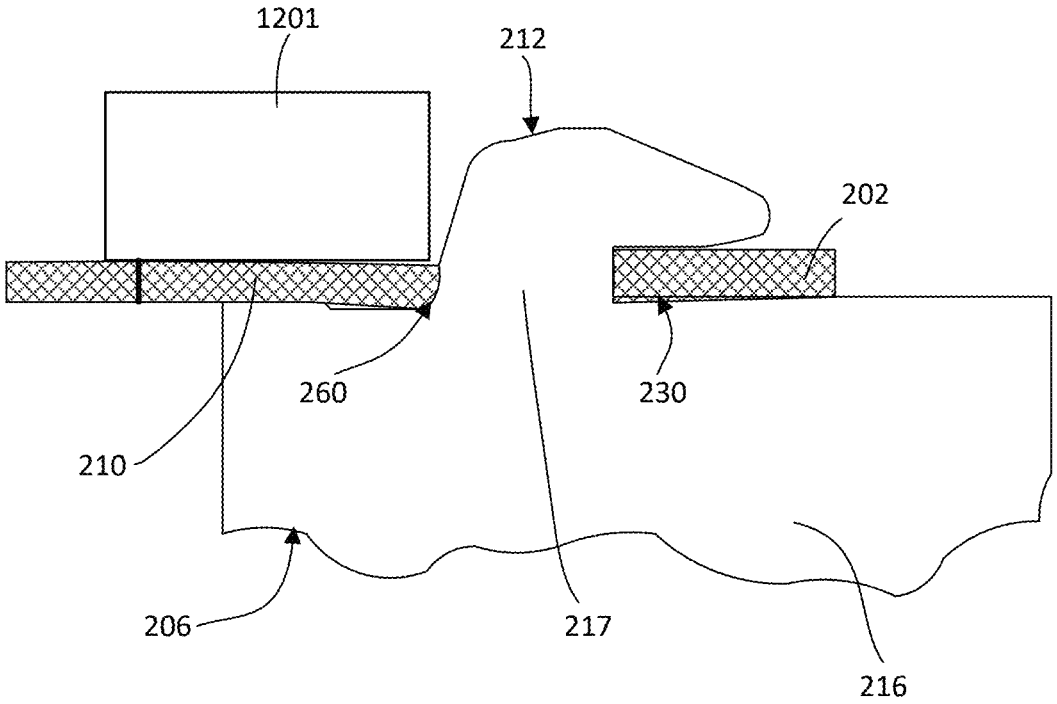
FIG. 16 is a front view of the blade and plate of FIG. 6, where the blade is connected to the plate.
Figure 17:
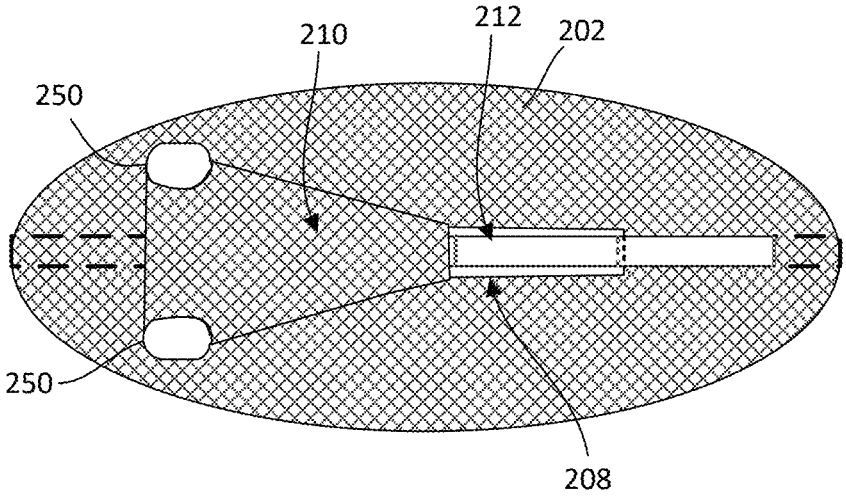
FIG. 17 is a top view of the blade and plate of FIG. 6, showing the blade connected to the plate as illustrate in FIG. 16.

Referring to FIGS. 14 and 15, a pressing tool of the pressing machine 1201 engages the locking projection 210 and provides a force F to the locking projection to move the locking projection toward the closed position. This engagement between the pressing machine 1201 and the locking projection 210 can cause the locking projection 210 to pivot at the first curved portion 274 such that the first elongated portion 270 moves toward and engages the blade 206. Referring to FIGS. 16 and 17, the continued force F provided by the pressing machine 1201 causes the locking projection 210 to continue pivoting at the first curved portion 274, and also causes the second curved portion 276 to be flattened due to the engagement between the locking projection 210 and the blade 206. The pivoting of the first curved portion 274 and the flattening of the second curved portion 276 causes the locking projection 210 to be substantially aligned with the main body of the plate 202 when in the closed position. In certain embodiments, the second elongated portion 272 of the locking projection 210 is inserted into the receiving channel 260 of the blade 206 when in the closed position to aid in maintaining a secure connection between the blade 206 and the plate 202. In some implementations, the engagement between the elongated portion 272 of the locking projection 210 and the receiving channel 260 of the blade 206 causes a deformation of the elongated portion 272 of the locking projection 210 within the channel 260 that assures a tight connection between the blade 206 and the plate 202 in the direction X. This tight connection prevents relative movement between the blade 206 and the plate 202 such that the blade 206 is securely connected to the plate 202.

Figure 18:
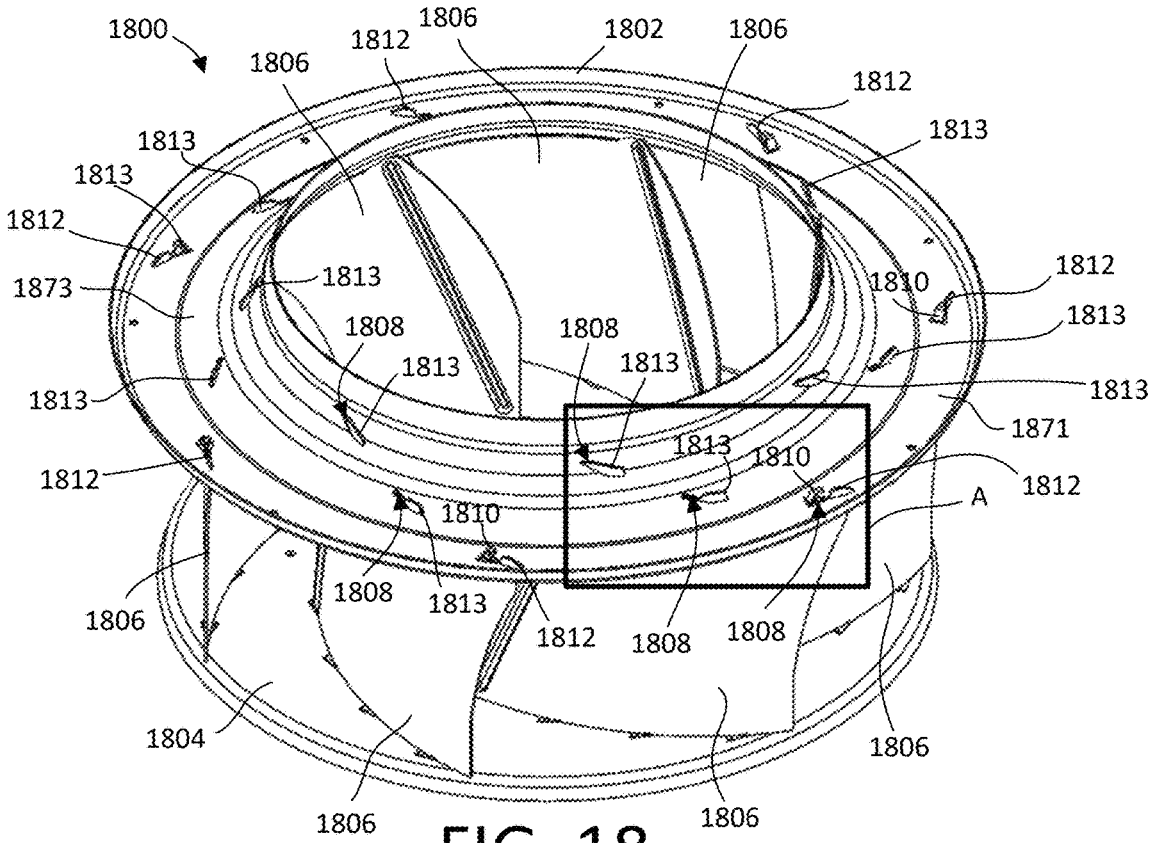
FIG. 18 is a top isometric perspective view of another exemplary embodiment of an impeller.
Figure 19:
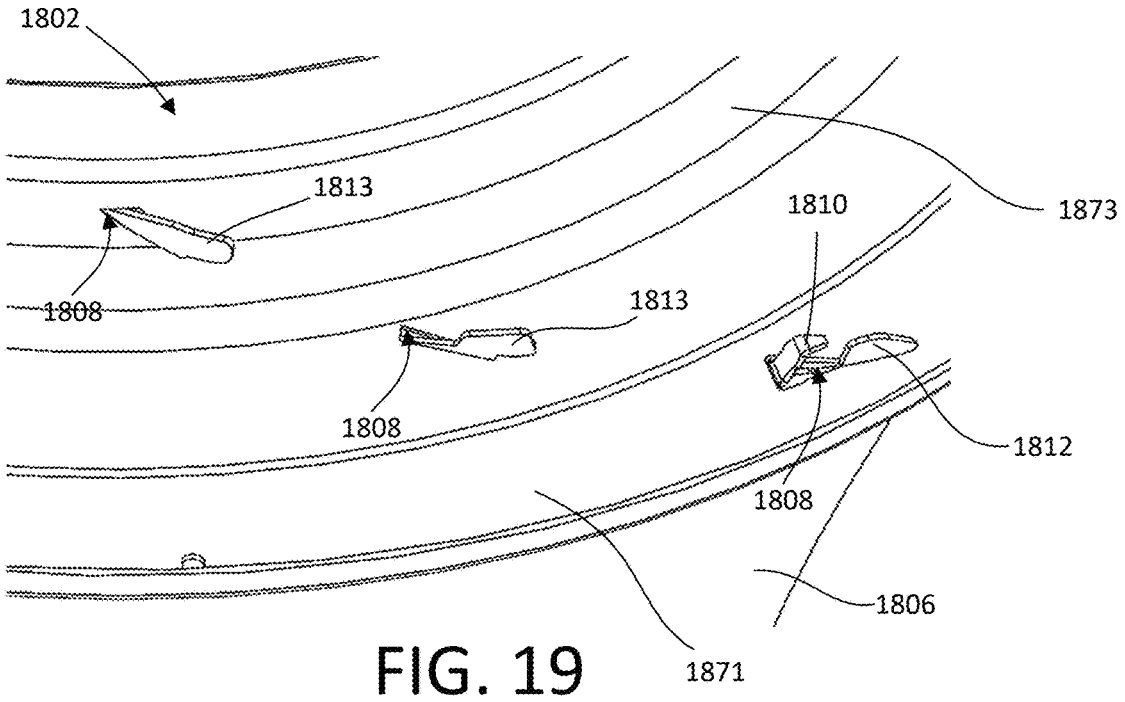
FIG. 19 is a partial isometric perspective view of the impeller of FIG. 18 showing the portion of the impeller within the box A in FIG. 18.

FIGS. 18 and 19 illustrate another embodiment of an impeller 1800. The impeller 1800 includes a front plate 1802, a back plate 204, and a plurality of blades 1806. The front and back plates 1802, 1804 can be made of a metal material, such as, for example, steel, aluminum, or any other suitable material. The blades 1806 can be made of, for example, steel, aluminum, plastic, filled polymer, or any other suitable material. In the illustrated embodiment, the blades 1806 are backward-curved blades. In other embodiments, the blades 1806 can be straight blades or forward-curved blades, airfoil blades, or any other suitable shape blades. The blades 1806 can take any suitable form, such as, for example, any form described in the present application. The impeller 1800 can be used in a fan for an HVAC system (e.g., the fan 2200 shown in FIG. 22). The back plate 1804 can be connected to a motor by any suitable means, such as, for example, any means described in the present application with regards to impeller 200.

The plates 1802, 1804 can have one or more openings 1808 for receiving tabs of the blades 1806. The plates 1802, 1804 can also have one or more locking projections 1810, wherein the locking projection 1810 is configured for securing a tab of the blades 1806 within a corresponding opening 1808. Some of the openings 1808 may have a corresponding locking projection 1810, and other openings 1808 may not have a corresponding locking projection. In the illustrated example, the front plate 1802 includes three openings 1808, where only one of the openings 1808 has a corresponding locking projection 1810. The opening 1808 with the corresponding locking projection 1810 is positioned on a flat portion 1871 of the front plate 1802, where the other two openings 1808 that do not include a corresponding locking projection are positioned on a curved portion 1873 of the front plate 1802. However, it should be understood that the front plate 1804 can have one or more openings that have a corresponding locking projection and one or more openings that do not include a corresponding locking projection, and any of these openings can be positioned on the flat portion 1871 and/or the curved portion 1873. The back plate 1804 can have any suitable number of openings and locking projections. For example, the rear plate 1804 can take the same form as the rear plate 204 for the impeller 200 shown in FIG. 5. In other instances, the rear plate 1804 may include one or more openings 1808 that do not include a corresponding locking projection.

The locking projections 1810 on both the front plate 1802 and the back plate 1804 are configured to be moved from a normal position (e.g., similar to the locking projections 210 shown in FIGS. 6-13) to a closed position (e.g., similar to the locking projections 210 shown in FIGS. 4-5 and 16-17) relative to the openings 1808. The locking projections 1810 may be moved between the normal and closed positions by a pressing tool (e.g., any pressing tool described in the present application).

The blades 1806 have tabs 1812 that are configured to extend through the openings 1808 of the front plates 1802 that have corresponding locking projections 1810 and tabs 1813 that are configured to extend through the openings 1808 of the front plate 1802 that do not have corresponding locking projections. The tabs 1812 can be secured to the front plate 1802 by the locking projections 1810 in the same manner that the tabs 212 are secured to the front plate 202 by the locking projections 210, as described with reference to FIGS. 4-17. The tabs 1813 are configured to engage the front plate 1802 such that the tabs 1813 maintain a secure position relative to the front plate 1802 when the tabs 1812 are secured to the front plate 1802 by the locking projections 1810. For example, the tabs 1813 can include a slot that is similar to the slot 230 of the blades 206 shown in FIGS. 6-17, but the slot for the tabs 1813 can be sized and shaped such that the tabs 1813 maintain a secure engagement with the front plate 1802 when the tabs 1812 are secured to the front plate 1802 by the locking projections 1810.

In the illustrated example, the tabs 1813 extend through an opening 1808 and engage the curved portion 1873 of the front plate 1802 to maintain a secured position relative to the front plate 1802. Referring to FIG. 19, the tabs 1812, 1813 are shown extending through the openings 1808 of the front plate 1802, and the locking projections 1810 are shown in a normal position (e.g., similar to the position of the locking projections 210 and tabs 212 of the impeller 200 shown in FIGS. 12-13). Movement of the locking projections 1810 to the closed position (e.g., similar to the position of the locking projections 210 and tabs 212 shown in FIGS. 16-17) causes the blades 1806 to be secured to the front plate 1802. While the illustrated example shows each blade 1806 having one tab 1812 that is engaged by a locking projection 1810 on the front plate 1802 and two tabs 1813 that are not engaged by locking projections on the front plate 1802, it should be understood that the blades 1806 can have any suitable number of tabs that are engaged by locking projections on the front plate 1802 or back plate 1804 and any suitable number of tabs for securing the blades to the front plate or back plate that are not engaged by locking projections.

Figure 21:
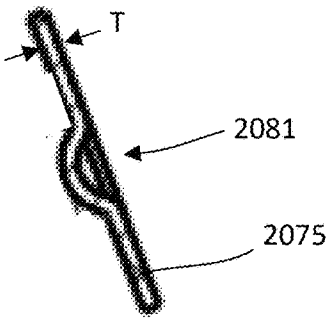
FIG. 21 is a partial cross-sectional view of the blade of FIG. 20 showing an example of an embossment of the blade.
Figure 20:
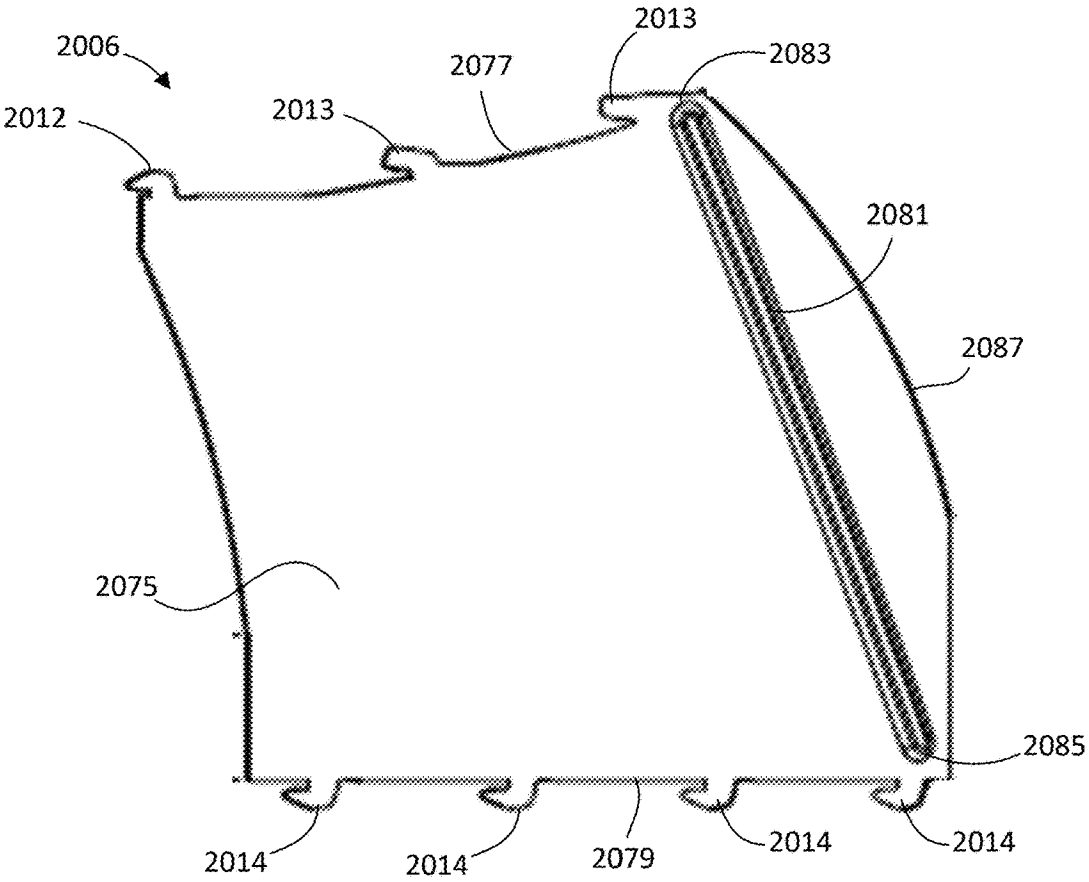
FIG. 20 is a side view of an exemplary embodiment of a blade for an impeller.

Referring to FIGS. 20 and 21, an example of a blade 2006 for an impeller (e.g., any impeller described in the present application) includes a main body 2075, a top edge 2077 for connecting to a front plate of the impeller, and a bottom edge 2079 for connecting to a back plate of the impeller. The top edge 2077 can have one or more tabs 2012, 2013 for connecting the blade 2006 to the front plate, and the bottom edge 2079 can have one or more tabs 2014 for connecting the blade 2006 to the back plate. In the illustrated example, the top edge 2077 has one tab 2012 that is configured to be engaged by a locking projection of the front plate (e.g., similar to the engagement between the tab 212 and the locking projection 210 for the impeller 200 shown in FIGS. 4-17), and the top edge 2077 has two tabs 2013 that are configured to engage a curved portion of the front plate when the tab 2012 is secured to the front plate by a locking projection (e.g., similar to the engagement between the tabs 1813 and the curved portion 1873 of the front plate 1802 shown in FIGS. 18-19). In the illustrated example, the bottom edge 2079 has four tabs 2014 that are configured to be engaged by locking projections of the back plate (e.g., similar to the engagement between the locking projections 210 and the tabs 212, 214 shown in FIGS. 4-17). It should be understood that the top edge 2077 can have any suitable number of tabs 2012, 2013 and the bottom edge 2079 can have any suitable number of tabs 2014. It should also be understood that the bottom edge 2079 can have one or more tabs that are configured for securing the blade 2006 to the bottom plate but are not engaged by a locking projection of the bottom plate (e.g., similar to the tabs 2013 of the top edge 2077).

The main body 2075 of the blade can include an embossment 2081 that provides structural support to the blade 2006. The embossment can be configured to allow the blade 2006 to have a smaller thickness T while maintaining sufficient strength such that the blade 2006 does not collapse or otherwise fail as the impeller is being used with an HVAC system. In the illustrated example, the embossment 2081 is linear such that it extends in a straight line between a first end 2083 and a second end 2085. However, it should be understood that the embossment 2081 can take any other suitable shape that is capable of providing sufficient strength to the blade. In the illustrated example, the embossment 2081 is positioned proximate a forward edge 2087 of the blade 2006. However, it should be understood that the embossment 2081 can be positioned at any other suitable location on the blade 2006 that allows for the embossment 2081 to provide sufficient strength to the blade.

Figure 22:
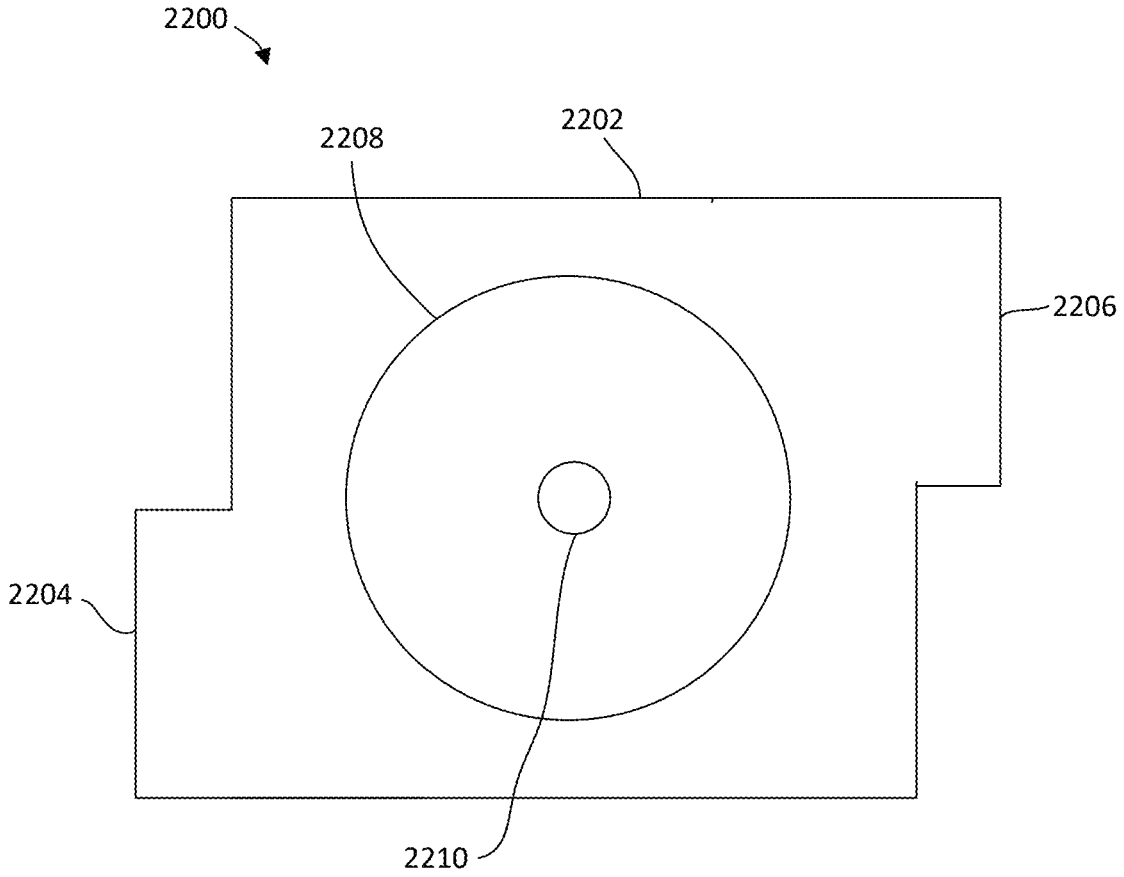
FIG. 22 is a schematic drawing of an exemplary embodiment of a fan.

Referring to FIG. 22, an exemplary fan 2200, such as a fan for an HVAC system, can include a housing 2202 having an inlet 2204 and an outlet 2206, an impeller 2208, a drive shaft 2210, and a drive mechanism (not shown). The housing 2202 can take any suitable form, such as, for example, any suitable form for a housing of a fan for an HVAC system. The impeller 2208 can take any suitable form, such as, for example, the form of the impellers 100, 200 described in the present application. The drive shaft 2210 is connected to the impeller 2208, and the drive mechanism is configured to rotate the drive shaft 2210 to rotate the impeller 2208 such that air moving into the inlet 2204 is moved through the outlet 2206. The drive mechanism can be, for example, an electric motor or any other suitable drive mechanism.

While various inventive aspects, concepts and features of the inventions may be described and illustrated herein as embodied in combination with exemplary embodiments, these various aspects, concepts and features may be used in many alternative embodiments, either individually or in various combinations and sub-combinations thereof. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein.

Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

The invention claimed is:

1. An impeller, comprising:

a front plate having one or more first openings and one or more first locking projections;

a back plate having one or more second openings and one or more second locking projections; and a plurality of blades, each blade having one or more first tabs and one or more second tabs, wherein the first tabs and the second tabs each have a slot for receiving one of the front plate and the back plate;

wherein the one or more first tabs of the plurality of blades extend through the one or more first openings of the front plate and the front plate is received by the slots of the one or more first tabs to assemble the blade to the front plate;

wherein the one or more second tabs of the plurality of blades extend through the one or more second openings of the back plate and the back plate is received by the slots of the one or more second tabs to assemble the blade to the back plate;

wherein the first locking projections are moved to the closed position to lock the plurality of blades to the front plate; and wherein the second locking projections are moved to the closed position to lock the plurality of blades to the back plate.

2. The impeller according to claim 1, wherein at least one of the first tabs has a receiving channel that receives a corresponding first locking projection of the plurality of first locking projections.

3. The impeller according to claim 1, wherein each of the blades has more second tabs than first tabs.

4. The impeller according to claim 1, wherein each of the blades has an embossment for providing structural support to the blade.

5. The impeller according to claim 1, wherein the blades comprise backward-curved blades.

6. The impeller according to claim 1, wherein:

a length of the one or more first locking projections plus a length of the one or first tabs is longer than a length of the one or more first openings; and a length of the one or more second locking projections plus a length of the one or second tabs is longer than a length of the one or more first openings.

7. The impeller according to claim 1, wherein:

wherein in a closed position the first locking projections extend into the first openings; and wherein in a closed position the second locking projections extend into the second openings.

8. An impeller, comprising:

a front plate having one or more first openings and one or more first locking projections;

a back plate having one or more second openings and one or more second locking projections; and a plurality of blades, each blade having one or more first tabs and one or more second tabs;

wherein the one or more first tabs of the blades are configured to be inserted into the one or more first openings of the front plate;

wherein a length of the one or more first locking projections plus a length of the one or first tabs is longer than a length of the one or more first openings;

wherein the one or more first locking projections are configured to be moved to a closed position relative to the one or more first openings such that the one or more first locking projections engage the one or more first tabs and cause the one or more first tabs to be secured to the front plate;

wherein in the closed position the first locking projections extend into the first openings in a direction of the length of the first openings;

wherein the one or more second tabs of the blades are configured to be inserted into the one or more second openings of the back plate;

wherein a length of the one or more second locking projections plus a length of the one or second tabs is longer than a length of the one or more first openings; and wherein the one or more second locking projections are configured to be moved to a closed position relative to the one or more second openings such that the one or more second locking projections engage the one or more second tabs and cause the one or more second tabs to be secured to the back plate; and wherein in a closed position the second locking projections extend into the second openings in a direction of the length of the second openings.

9. The impeller according to claim 8, wherein at least one of the first locking projections and at least one of the second locking projections have one or more curved portions for facilitating movement of the first and second locking projections to the closed position.

10. The impeller according to claim 8, wherein the first and second locking projections are configured to be moved to the closed position by a pressing machine.

11. The impeller according to claim 8, wherein at least one of the first tabs has a first slot that receives the front plate and at least one of the second tabs has a second slot that receives the back plate, and wherein each of the blades is secured to the front plate and the back plate when the front plate is disposed in the first slot and the back plate is disposed in the second slot.

12. The impeller according to claim 8, wherein at least one of the first tabs has a receiving channel that receives a corresponding first locking projection of the plurality of first locking projections.

13. The impeller according to claim 8, wherein each of the blades has more second tabs than first tabs.

14. The impeller according to claim 8, wherein each of the blades has an embossment for providing structural support to the blade.

15. The impeller according to claim 8, wherein each of the first tabs comprises one or more tapered walls that facilitate insertion of the first tabs into the first openings of the front plate.

16. The impeller according to claim 8, wherein the blades comprise backward-curved blades.

17. A method of assembling an impeller, the method comprising:

inserting one or more first tabs of a blade into one or more first openings of a front plate;

moving the blade relative to the front plate in a radially outward direction to removably attach the blade to the front plate by moving the front plate into a slot of each of the one or more first tabs;

moving one or more first locking projections of the front plate to a closed position relative to the one or more first openings to secure the blade to the front plate;

inserting one or more second tabs of the blade into one or more second openings of a back plate;

moving the blade relative to the back plate in a radially outward direction to removably attach the blade to the back plate by moving the back plate into in a slot of each of the one or more second tabs; and moving one or more second locking projections of the back plate to a closed position relative to the one or more second openings to secure the blade to the front plate.

18. The method according to claim 17, wherein the one or more first locking projections and the one or more second locking projections are moved to the closed position by a pressing machine.

19. The method according to claim 17, wherein insertion of the one or more first tabs into the one or more first openings positions causes the first tabs to engage the first locking projections and maintain a desired position relative to the front plate.

20. The impeller according to claim 17, wherein:

a length of the one or more first locking projections plus a length of the one or first tabs is longer than a length of the one or more first openings; and a length of the one or more second locking projections plus a length of the one or second tabs is longer than a length of the one or more first openings.

* * * * *